US005341842A

United States Patent [19]

Chih et al.

[11] Patent Number: 5,341,842

[45] Date of Patent: Aug. 30, 1994

[54] BOTTOM MOUNT FUEL TANK MODULE FOR AN AUTOMOBILE

[75] Inventors: Ming-Niu Chih, Dearborn Heights, Mich.; Michael H. Johnston, Bloomington, Ind.

[73] Assignee: Ford Motor Company, Dearborn, Mich.

[21] Appl. No.: 89,200

[22] Filed: Jul. 12, 1993

[51] Int. Cl.[5] ..... F02M 37/04

[52] U.S. Cl. ..... 137/574; 137/576; 123/514; 123/516

[58] Field of Search ..... 137/574, 576; 123/509, 123/514, 516

[56] References Cited

U.S. PATENT DOCUMENTS

| | | | |
|---|---|---|---|
| 2,767,736 | 10/1956 | Lackinger | 137/574 |
| 2,953,156 | 9/1960 | Bryant | 137/576 X |
| 3,020,950 | 2/1962 | Schraivogel | 137/574 |
| 3,049,171 | 8/1962 | Neuerburg et al. | 137/574 |
| 4,397,333 | 8/1983 | Liba et al. | 137/574 |
| 4,431,027 | 2/1984 | Sabina, Jr. | 137/574 |
| 4,503,885 | 3/1985 | Hall | 137/574 |
| 4,694,857 | 9/1987 | Harris | 137/574 X |
| 4,860,714 | 8/1989 | Bucci | 123/514 |
| 4,869,225 | 9/1989 | Nagata et al. | 123/509 |
| 4,899,784 | 2/1990 | Woodgate et al. | 137/574 |
| 5,016,670 | 5/1991 | Sasaki et al. | 137/574 |
| 5,070,849 | 12/1991 | Rich et al. | 123/509 |
| 5,080,077 | 1/1992 | Sawert et al. | 123/514 |
| 5,139,000 | 8/1992 | Sawert | 123/514 |
| 5,218,942 | 6/1993 | Coha et al. | 123/514 |

FOREIGN PATENT DOCUMENTS

| | | |
|---|---|---|
| 844599 | 4/1958 | Fed. Rep. of Germany . |
| 864369 | 11/1959 | Fed. Rep. of Germany . |
| 2069431A | 2/1981 | United Kingdom . |

*Primary Examiner*—John Rivell

*Attorney, Agent, or Firm*—David B. Kelley; Roger L. May

[57] ABSTRACT

A module which fits into a cup attached to the bottom of an automotive fuel tank contains a fuel pump, a fuel filter, a jet pump and associated manifold components for maintaining a minimum level of fuel in a reservoir to provide a continuous source of fuel to the fuel pump when the tank fuel level is low or when vehicle operations, such as cornering, braking, acceleration, or slope parking cause the tank fuel level to fall below the fuel pump inlet.

9 Claims, 2 Drawing Sheets

BOTTOM MOUNT FUEL TANK MODULE FOR AN AUTOMOBILE

FIELD OF THE INVENTION

This invention pertains to motor vehicle fuel pump senders, and specifically to means for maintaining a sufficient fuel level at the fuel pump inlet.

BACKGROUND OF THE INVENTION

Fuel tanks, particularly in automobiles, typically contain a fuel pump which may be mounted on the bottom of the tank. It is desirable to position the inlet of the fuel pump as near as possible to the lowest level in the tank so that a source of fuel will be available even when fuel level is low. Despite such a placement of the fuel inlet, events during vehicle operation such as cornering, braking and acceleration can cause the fuel to "slosh" around, potentially uncovering the fuel pump inlet. Driving or parking on a slope could similarly result in the fuel pump inlet being uncovered. When the inlet is exposed, the fuel pump sucks air (or fuel vapor) causing the engine to stammer and stall. An additional problem occurs at engine start-up when fuel tank level is low and there is insufficient fuel at the pump inlet.

Various methods have been devised to solve the above mentioned problems. Damming means which form a reservoir within a cylinder in the tank to keep fuel covering the fuel pump inlet was disclosed in U.S. Pat. Nos. 4,397,333 and 4,503,885. Those patents also disclosed a jet aspirator to continually draw fuel into the reservoir. The reservoirs in these devices are relatively small and the jet aspirator does not keep the cylinder filled after the engine is turned off since fuel leaks out through the fuel return conduit. Thus, the level of fluid available at engine start-up is limited to that in the reservoir.

Another method for providing fuel to the fuel pump intake is to induce fuel into a reservoir by directing return fuel over a ramp past an opening in the reservoir. Several patents disclose variations on this method, including U.S. Pat. No. 4,899,784. However, fuel will leak out of the swirl pot of this device when vehicle operation ceases.

SUMMARY OF THE INVENTION

The present invention overcomes the shortfalls of these previous methods by providing a module with an integrally molded jet pump which continuously draws fuel from the tank to keep a reservoir containing the fuel pump completely full. The reservoir continually overflows during vehicle operation. When operation ceases, the reservoir is kept at a minimum level so that more than sufficient fuel is available at the fuel pump inlet for engine start-up in the event fuel tank level is low.

The invention is a fuel delivery module for supplying fuel to an automobile engine from a fuel tank. The module comprises a reservoir, a fuel pump within the reservoir, and means for drawing fuel from the tank into a conduit having a conduit outlet within the reservoir such that the reservoir remains filled during fuel pump operation, with the conduit arranged such that the conduit outlet is above a fuel inlet to the fuel pump, and the reservoir remains filled to the minimum height of the conduit outlet when operation of the fuel pump and the engine ceases.

Therefore, an object of the present invention is to provide a fuel tank module mountable on the tank bottom which is continuously filled with fuel during vehicle operation and which maintains a high level of fuel in the module reservoir when operation ceases.

Another object of the invention is to provide a fuel tank module containing a fuel pump, a fuel filter, a jet pump and associated manifold components for maintaining a high minimum level of fuel in a reservoir to provide a continuous source of fuel to the fuel pump when the tank fuel level is low or when vehicle operations, such as cornering, braking or acceleration, would cause the tank fuel level to fall below the pump inlet.

Still another object of the present invention is to provide a fuel pump module which can be easily snapped into and out of a cup mounted on the bottom of the fuel tank allowing easier assembly and maintenance.

But yet another object of the present invention is to provide a fuel pump module which contains integrally molded components for easier and more economical manufacture and assembly.

Yet another object of the present invention is to provide a fuel pump assembly which is modular and contains fewer parts to manufacture and assemble.

A further object of the present invention is to provide a fuel pump module which reduces fuel pump temperature and noise.

Still a further object of the present invention is to provide a fuel pump module which improves hot fuel handling capability.

Another object of the present invention is to provide a fuel module capable of maintaining sufficient fuel at the fuel pump inlet during driving or slope parking.

DETAILED DESCRIPTION OF THE PREFERRED EMBODIMENTS

Figure 1:
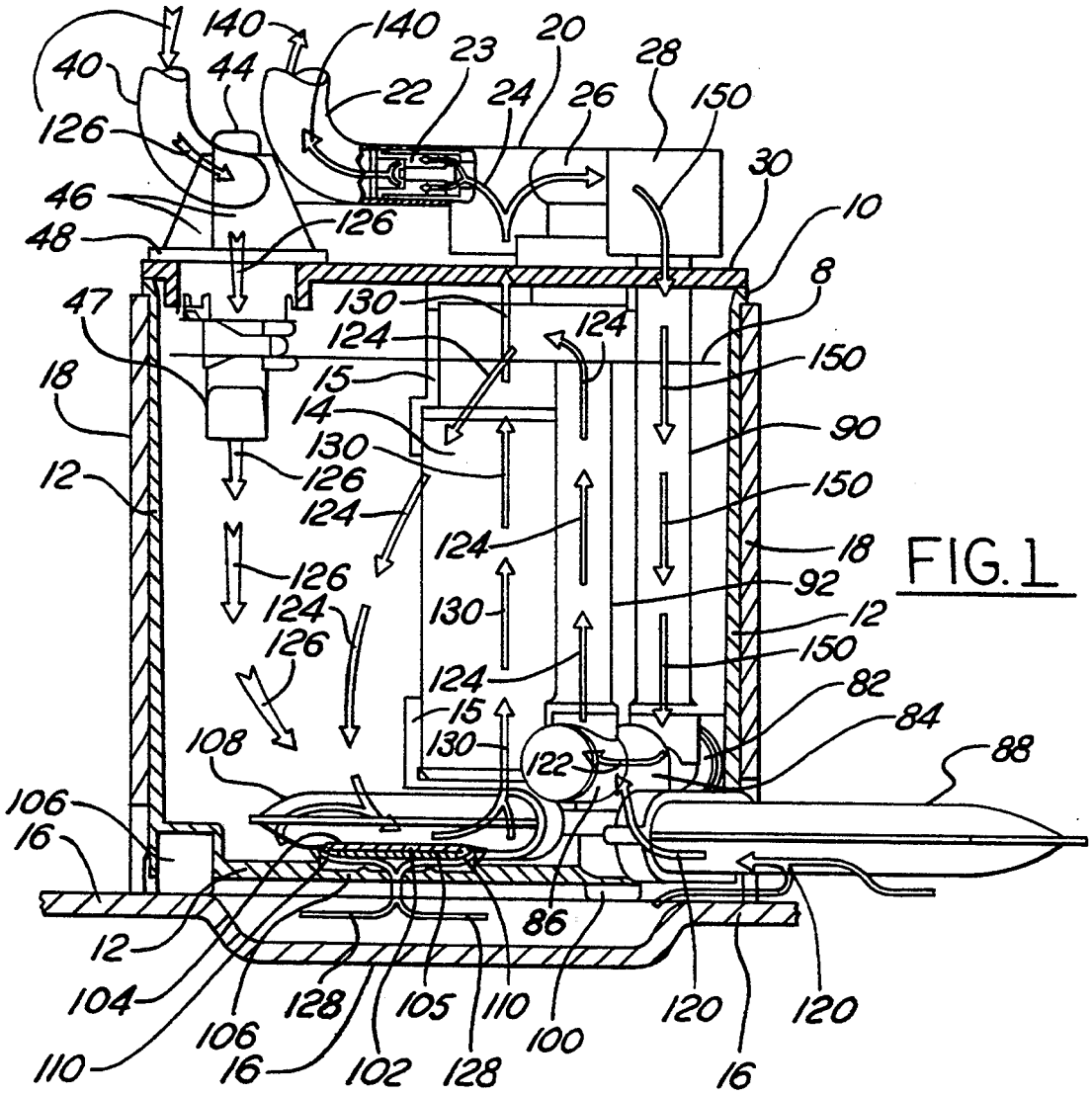
FIG. 1 is a schematic view of the present invention showing fuel flow through the fuel delivery module during normal vehicle operation.
Figure 2:
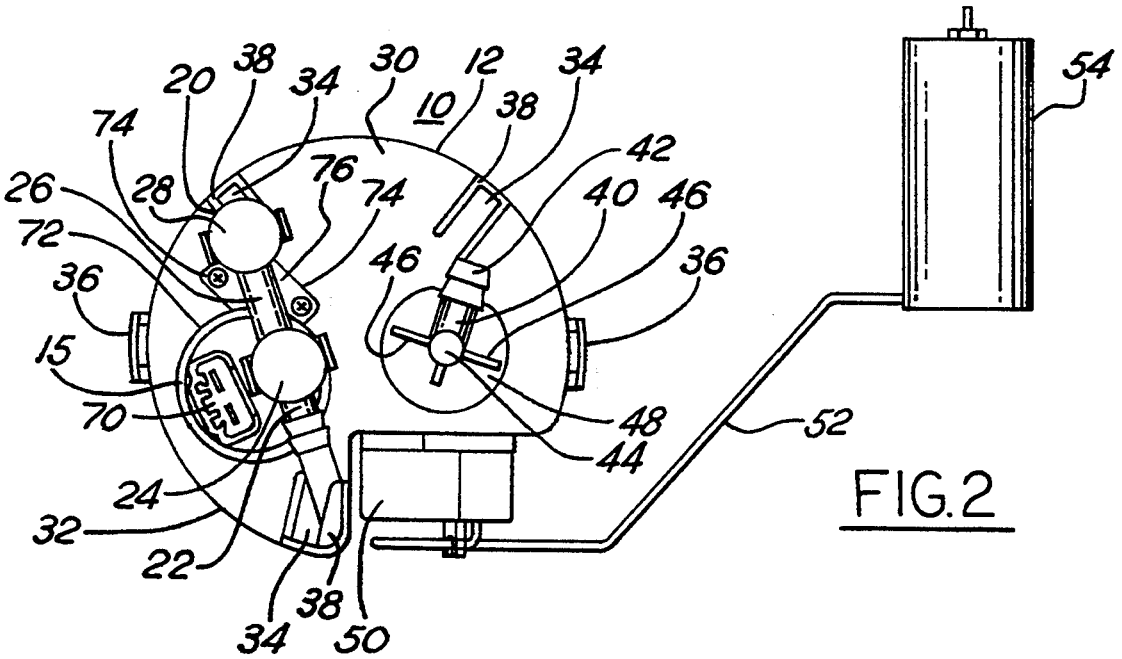
FIG. 2 is a top view of the present invention showing a fuel sender unit attached to the fuel delivery module.

Referring to the drawings, FIG. 1 shows fuel flow through a fuel delivery module 10 of the present invention. Module 10 has cylindrical shaped reservoir 12 which preferably is made of plastic. A fuel pump 14 is mounted within reservoir 12 by pump isolators 15. Fuel pump 14 is preferably a regenerative turbine type pump and has electrical connector 70 attached to its top protruding through hole 72 of reservoir cap 30. FIG. 2. Pump isolators 15 are preferably made of a vibration absorbent material such as rubber and cylindrically enclose a top portion and a bottom portion of fuel pump 14.

Reservoir cap 30 attaches to reservoir side 32 with clips 34. Reservoir cap 30 also has integrally molded clips 36 which attach to tank bottom cup 18 allowing the module 10 to be easily attached to the fuel tank 16. A manifold 20 for routing fuel is attached to module 10 by screws 74 which bind manifold base plate 76 to reservoir cap 30. The manifold 20 consists of four integrally molded sections, including engine fuel delivery conduit 22, fuel pump head 24, connecting conduit 26, and jet delivery conduit head 28. A one-way valve 23 is placed inside engine fuel delivery conduit 22 to prevent backflow of fuel from the engine to manifold 20. Engine fuel delivery conduit 22 is attached on one end to a fuel line (not shown) which leads to the engine (not shown), and on the other end to fuel pump head 24. Fuel pump head 24 is situated above fuel pump 14 and sealingly accepts a fuel pump outlet (not shown) from fuel pump 14. Connecting conduit 26 leads to jet delivery conduit head 28 which sealingly attaches above and is in fluid communication with jet fuel inlet conduit 90.

Reservoir 12 has feet 100, preferably made of a fuel resistant rubber such as HSN or Fluorosilicone, to insulate module 10 vibration and noise, especially from fuel pump 14.

Unused fuel from the engine is routed to return line inlet 40 through a fuel return line (not shown) which is coupled to return inlet connector 42. Return line inlet 40 leads to return inlet stem 44 which passes through return inlet base 48 and is in fluid communication with check valve 47. Check valve 47 acts as a roll-over protection device to prevent fuel flow out of the tank should the vehicle overturn. The return line inlet 40, inlet connector 42, inlet stem 44, inlet flanges 46 and inlet base 48 are integrally molded into a single piece which snaps into an opening in reservoir cap 30. Return inlet flanges 46 allow the single piece to be twisted into place.

Figure 3:
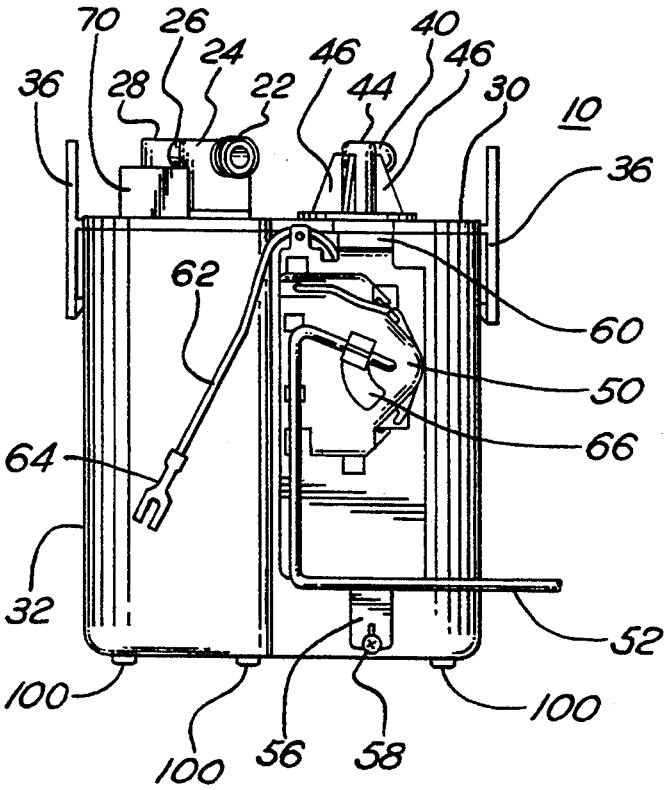
FIG. 3 is a side view of the present invention.

A conventional fuel sender unit 50 for sensing fuel level is attached to reservoir side 32 by sender bracket clip 60 which mounts over reservoir side 32 and sender bracket screw 58 screws through sender bracket 56 into reservoir side 32. FIG. 3. Float arm 52 has float 54 fixedly mounted on one end and attaches to sender unit 50 in sender resistor track 66-on the other end. Sender wire 62 transmits electrical information to a fuel level display, such as a fuel gage (not shown). Sender wire connector 64 connects to a wire leading to such a gage thus allowing easy connection and separation of module 10 from tank 16.

Figure 4:
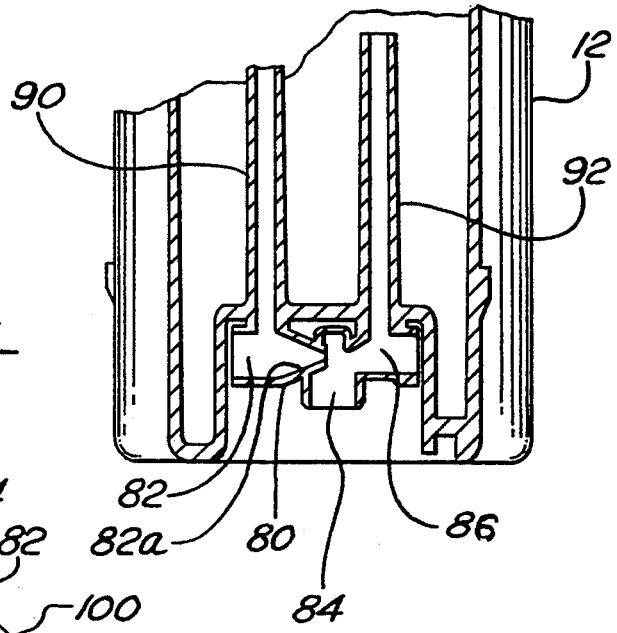
FIG. 4 is a side cut-away view of the jet pump and related conduits of the present invention.
Figure 5:
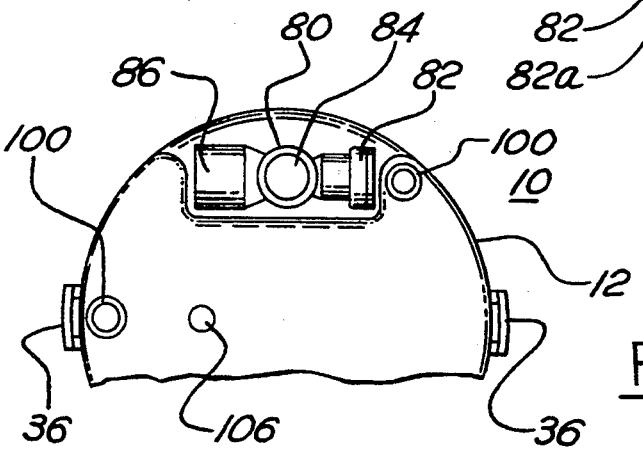
FIG. 5 is a partial view of the bottom of the present invention showing the jet pump and an orifice to allow fuel flow into the module at an initial start-up condition.

A jet pump 80 provides a means for drawing fuel from tank 16 to fill reservoir 12. The jet pump 80 consists of a fuel intake chamber 82 leading to a venturi opening 84 which draws fuel from tank 16 into a fuel outlet chamber 86. FIG. 4. The components of the jet pump 80 preferably are integrally molded with and made of the same material as reservoir 12 thus allowing simpler manufacture. Assembly and attachment of the jet pump 80 is also eliminated.

Intake chamber 82 is fluidly connected to feed fuel conduit 90 which is in fluid communication with jet return conduit head 28 of manifold 20. A narrowed portion 82*a* in intake chamber 82 acts as a nozzle which draws fuel into venturi opening 84 through external filter 88. FIGS. 1 and 4. The combined fuel from tank 16 and venturi opening 84 form a stream which passes into a fuel outlet chamber 86. A reservoir outlet conduit 92 is vertically positioned above fuel outlet chamber 86 and in fluid communication with it to direct fuel into reservoir 12.

A flapper valve 102 is inserted in the bottom of reservoir 12 to allow fuel to enter reservoir 12 when the fuel level in tank 16 is low and there is little or no fuel in reservoir 12. The flapper valve 102 consists of an enclosure 104 which houses a moveable valve piece 105, preferably made of fluorosilicone or other fuel resistant material. Enclosure 104 has enclosure spaces 110 which open into reservoir 12. When flapper valve 102 is in the open position, shown in FIG. 1, valve piece 105 is buoyed by fuel to rise within enclosure 104 uncovering fuel inlet orifice 106. There is little or no fuel above valve piece 105 and the force of the fuel underlying valve piece 105 allows it to float. Fuel from tank 16 flows through fuel inlet orifice 106, into enclosure 104, through enclosure spaces 110, through internal fuel filter 108 and into reservoir 12. Internal fuel filter 108 preferably is made of a fuel absorbent nylon fabric. Flapper valve 102 is in the closed position when sufficient fuel exists in reservoir 12 to force valve piece 105 to cover fuel inlet orifice 106 (not shown). The closed position will normally be the operating condition of flapper valve 102 since reservoir 12 will usually be filled to minimum fuel height 8.

Operation of fuel delivery module 10 is illustrated by arrows showing flow of fuel through the various components. FIG. 1. When fuel in tank 16 is low and reservoir 12 has little or no fuel, fuel pump 14 draws fuel from reservoir 12 through flapper valve 102 as described above. See arrows 128. Fuel passes through fuel pump 14 to fuel pump head 24 of manifold 20. See arrows 130. At manifold 20, the fuel flow splits into two streams. A first stream, shown by arrows 140, is routed through one-way valve 23, to engine fuel delivery conduit 22, and to the engine (not shown). The second stream, shown by arrows 150, is routed through connecting conduit 26, into jet delivery conduit head 28, and into jet fuel inlet conduit 90. A restrictor (not shown) in jet delivery conduit head 28 proportions flow to jet fuel delivery conduit. Preferably, the first stream (arrows 140) is eighty-five percent (85%) and the second stream (arrows 150) fifteen percent (15%) of the flow from the fuel pump (arrows 130).

The second stream (arrows 150) travel down through jet fuel inlet conduit 90 to the fuel intake chamber 82 of jet pump 80. As described above, a venturi effect is developed when fuel (arrows 122) is forced through narrowed portion 82*a* thus drawing fuel into venturi opening 84 from tank 16 through external filter 88. The combined fuel streams from tank 16 and jet fuel intake chamber 82 form a stream (arrows 124) which passes into jet fuel outlet chamber 86, into reservoir outlet conduit 92 and into reservoir 12.

After sufficient fuel has entered reservoir 12, flapper valve 102 will close and fuel pump 14 will draw fuel from reservoir 12 instead of directly from tank 16.

Return fuel from the engine (arrows 126) enters return line inlet 40, passes into return inlet stem 44, passes through check valve 47, and into reservoir 12.

During normal operation of the vehicle, fuel will continuously flow through module 10 in the manner described and reservoir 12 will eventually overflow through reservoir cap spaces 38 into tank 16. When the vehicle turns a corner, accelerates, decelerates, or parks or drives on a sloped surface, sufficient fuel will be available to fuel pump 14 even if the fuel level in tank 16 is lower than the fuel pump inlet (not shown) since reservoir 12 will be filled with fuel. When vehicle operation ceases and fuel pump 14 shuts off, a minimum level 8 of fuel, which is the height of reservoir outlet conduit 92 within reservoir 12, will remain in reservoir 12. That remaining fuel will not leak out since reservoir 12 has no openings below reservoir outlet conduit 92.

Variations and modifications of the described invention are possible without departing from its spirit and scope as defined by the following claims.

We claim:

1. A fuel delivery module for supplying fuel to an automobile engine from a fuel tank comprising:

a reservoir;

a reservoir cap attachably enclosing said reservoir and having spaces to allow fuel overage to flow from the reservoir to the tank;

a fuel pump within said reservoir having a fuel pump outlet passing through the cap;

a manifold attached to said cap exteriorly of said reservoir for receiving high pressure fuel flow from the fuel pump outlet, said manifold having an engine fuel delivery conduit for routing a first portion of said high pressure fuel flow to said engine, and a connecting conduit which routes a second portion of said high pressure fuel to conduit means passing through said cap and in fluid communication with a jet pump fuel inlet conduit; and a jet pump having a fuel intake chamber in communication with said jet pump fuel inlet conduit for receiving the second portion of high pressure fuel and routing said second portion past a venturi opening to draw fuel from the fuel tank into a fuel outlet chamber, through a vertically positioned reservoir outlet conduit within said reservoir, and into said reservoir with said reservoir outlet conduit arranged such that said reservoir outlet conduit is above a fuel inlet to said fuel pump, said reservoir remaining filled to a minimum height of said conduit outlet when said fuel pump and said engine cease operating.

2. A fuel delivery module according to claim 1, wherein a fuel tank inlet filter is attached to said jet pump opening.

3. A fuel delivery module according to claim 2, wherein a fuel pump inlet filter is attached to said fuel inlet within said reservoir.

4. A fuel delivery module according to claim 3, wherein said reservoir has a bottom with a tank side and a reservoir side, said bottom having a flapper valve in communication with said tank.

5. A fuel delivery module according to claim 4, wherein said reservoir cap has means for attachment to a cup secured to said tank.

6. A fuel delivery module according to claim 5, wherein means for sensing fuel level in said tank are attached to said reservoir.

7. A fuel delivery module according to claim 1, wherein said reservoir, said jet pump, said jet pump fuel inlet conduit, and said vertically positioned reservoir outlet conduit comprise a single unitary piece.

8. A fuel delivery module according to claim 1, wherein said cap has a plurality of clips for attaching said fuel delivery module to a module receiving cup in said fuel tank.

9. A fuel delivery module according to claim 1, wherein a return line inlet is attached to said cap exteriorly of and in fluid communication with said reservoir for routing fuel returned from the engine to the reservoir.

* * * * *